US008083542B2

(12) United States Patent
Kodaira

(10) Patent No.: US 8,083,542 B2
(45) Date of Patent: Dec. 27, 2011

(54) ELECTRICAL CONNECTOR

(75) Inventor: Yoshihiko Kodaira, Kanagawa (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 13/038,572

(22) Filed: Mar. 2, 2011

(65) Prior Publication Data

US 2011/0151682 A1 Jun. 23, 2011

Related U.S. Application Data

(63) Continuation of application No. PCT/JP2009/004098, filed on Aug. 25, 2009.

(30) Foreign Application Priority Data

Sep. 2, 2008 (JP) ..... 2008-225336

(51) Int. Cl.
*H01R 12/24* (2006.01)

(52) U.S. Cl. ..... 439/497

(58) Field of Classification Search ..... 439/497, 439/495, 267

See application file for complete search history.

(56) References Cited

U.S. PATENT DOCUMENTS

| | | | | |
|---|---|---|---|---|
| 5,738,545 | A | 4/1998 | Igarashi et al. | |
| 5,882,223 | A | 3/1999 | Igarashi | |
| 6,066,000 | A | 5/2000 | Masumoto et al. | |
| 7,267,574 | B2 * | 9/2007 | Wei et al. | 439/495 |
| 7,766,680 | B2 * | 8/2010 | Suzuki et al. | 439/260 |
| 7,946,872 | B2 * | 5/2011 | Taketomi et al. | 439/260 |
| 2007/0066127 | A1 * | 3/2007 | Inoue | 439/495 |

FOREIGN PATENT DOCUMENTS

| | | |
|---|---|---|
| JP | 4-135176 | 12/1992 |
| JP | 11-111404 | 4/1999 |
| JP | 2000-106237 | 4/2000 |
| JP | 2000-200641 | 7/2000 |
| JP | 2005-268018 | 9/2005 |
| JP | 2008-004350 | 1/2008 |

OTHER PUBLICATIONS

PCT International Search Report cited in co-pending International Application No. PCT/JP2009/004098, dated Sep. 29, 2009, 4 pages.

* cited by examiner

*Primary Examiner* — Phuong Dinh
(74) *Attorney, Agent, or Firm* — Barley Snyder

(57) ABSTRACT

An electrical connector is provided that has adequate shielding and does not compromise workability. The electrical connector includes a housing, an actuator, a shield plate, a plurality of signal contacts, a shield contact, a pair of pegs and a shield shell. An upper surface of the electrical connector is covered with the shield plate and the shield shell, both of which are made of a conductive material, and the shield plate and the shield shell are connected to a grounding pattern on a printed wiring board for grounding. In addition, shield paths are formed in an open space between the shield plate) and the shield shell to divide the open space into left and right non-shielded areas and a central non-shielded area. The connector can be shielded with reliability from an electromagnetic wave produced by the connector itself or an external electromagnetic wave with the open space remaining.

22 Claims, 8 Drawing Sheets

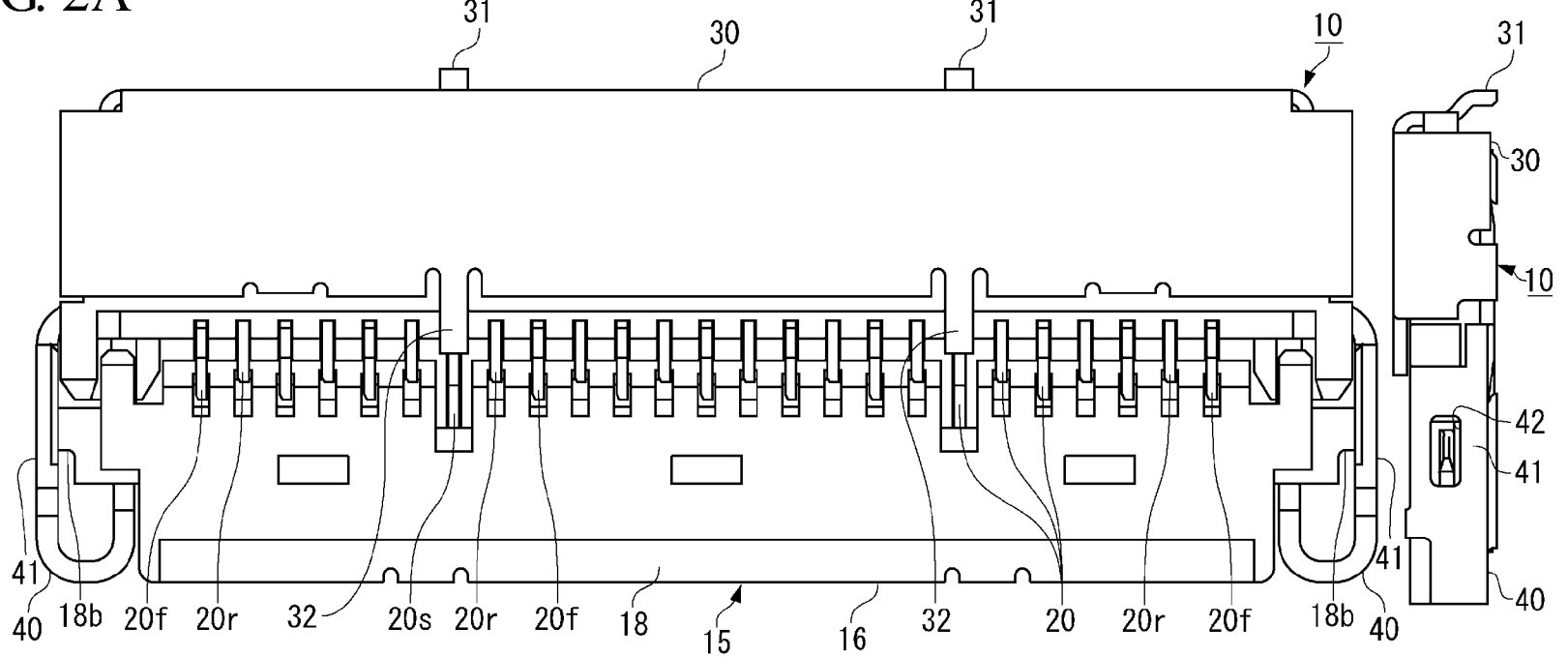
FIG. 2C
FIG. 2A
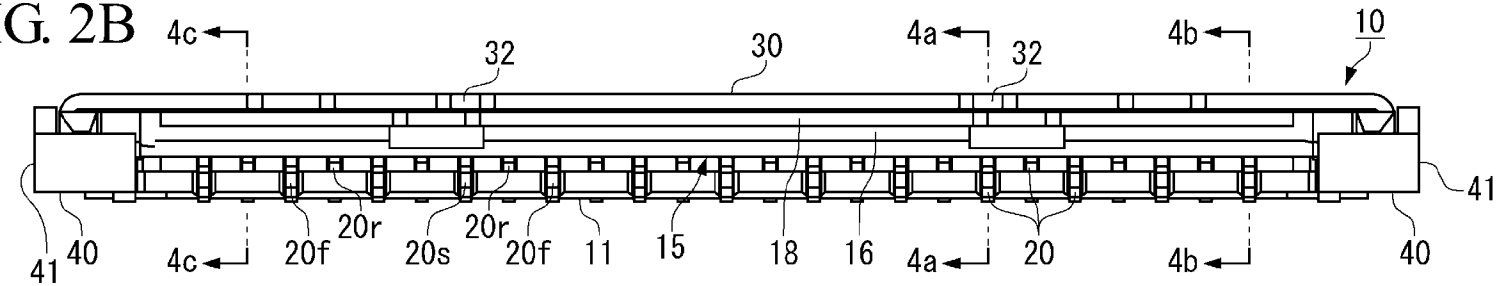
FIG. 2B

ELECTRICAL CONNECTOR

CROSS-REFERENCE TO RELATED APPLICATIONS

This application is a continuation of PCT International Application No. PCT/JP2009/004098 filed Aug. 25, 2009, which claims priority under 35 U.S.C. §119 to Japanese Patent Application No. JP 2008-225336, filed Sep. 2, 2008.

FIELD OF INVENTION

The present invention relates to an electrical connector, and in particular an electrical connector to which a flat cable having flexibility, such as a flexible printed circuit (FPC) and a flexible flat cable (FFC), is connected.

BACKGROUND

An electrical connector to which a flat cable having flexibility, such as FPC and FFC, is connected (referred to simply as a connector hereinafter) is mounted on a printed wiring board. A plurality of signal contacts are provided in the housing of the connector to be electrically connected to the printed wiring board. Electrical connection between the flat cable and the printed wiring board is established by electrically connecting these contacts to a conductor of the flat cable.

Typically, the flat cable is clamped with the signal contacts in order to maintain the electrical connection between the signal contacts and the conductor of the flat cable in the connector, with the signal contacts pressed against the conductor of the flat cable by means of the elasticity of the signal contacts themselves.

The connector of this type is covered with a shielding body made of a conductive material, in order to prevent electromagnetic interference (EMI) (see Japanese Patent Laid-Open No. 2005-268018 and Japanese Patent Laid-Open No. 2008-4350, for example).

For example, the connector disclosed in Japanese Patent Laid-Open No. 2005-268018 has a shield case formed by a conductive metal plate that covers the outer periphery of the connector.

The connector disclosed in Japanese Patent Laid-Open No. 2008-4350 is shielded from an electromagnetic wave with a pressing member that is pivoted to the signal contacts and presses the signal contacts and sheet metal covering the housing.

However, for the connector disclosed in Japanese Patent Laid-Open No. 2005-268018, the shield case has to be removed before insertion or removal of the flat cable. As a result, when the connector is assembled into an electrical appliance, workability 12 in connecting the flat cable to the connector decreases.

The connector disclosed in Japanese Patent Laid-Open No. 2008-4350 has an open space between the pressing member (actuator) and the sheet metal above the signal contact. The open space is a non-shielded area, and therefore, the connector disclosed in Japanese Patent Laid-Open No. 2008-4350 has inadequate electromagnetic wave shielding (referred to simply as shielding, hereinafter).

SUMMARY

Accordingly, the invention has been made to solve the above problems, and an objective of the present invention, among others, to provide a connector that has an adequate shielding and does not compromise the workability.

From the viewpoint of shielding, the open space above the signal contact is preferably covered with the shield member. However, it may be impossible because of the hinge structure of the actuator and the housing.

Here, the non-shielded area is a rectangular area corresponding to the open space. Provided that the wavelength at the transmission frequency of the connector is denoted by $\lambda$, the electromagnetic wave at the frequency does not pass through the non-shielded area if the largest dimension defined by as the diagonal length of the non-shielded area is equal to or less than $\frac{1}{4}\lambda$. Therefore, if a shield path that divides the non-shielded area corresponding to the open space is formed so that the largest dimension of each of the resulting non-shielded areas is equal to or less than $\frac{1}{4}\lambda$, shielding of the open space can be ensured without using a shield member that covers the open space.

An electrical connector, according to the invention, is mounted on a surface of a printed wiring board and electrically connects a flexible flat cable having a shield layer made of a conductive material on a surface thereof to the printed wiring board. The electrical connector includes a housing, an actuator, a shield plate, a plurality of signal contacts, a shield contact, a pair of pegs and a shield shell. The housing is made from an insulating material and mounted to a printed circuit board. An end of the flat cable having a shield layer is inserted from one end side to the another end side of the housing. The actuator is positioned at the one end side or other end side of the housing and includes cams. The shield plate is positioned with the actuator and made from a conductive material, the shield plate covers an upper surface of the electrical connector at the one end side or the other end side. The plurality of signal contacts are arranged along a width of the housing, and clamp the end of the flat cable. The plurality of signal contacts are electrically connected to a printed wiring board, the plurality of signal contacts cooperate with the actuator through the cams to clamp the end of the flat cable and are electrically connected to the printed wiring board. The shield contact is disposed between the plurality of signal contacts in the housing, while the pair of pegs are positioned on opposite ends of the housing and electrically connected to a grounding pattern on the printed wiring board. The pair of pegs are in contact with the shield plate when the actuator clamps the end of flat cable. The shield shell is made from a conductive material, covers an upper surface of the housing, and connects to the grounding pattern on the printed wiring board. The shield plate, the shield layer of the flat cable, the shield contact and the shield shell are electrically connected and form a shield path when actuator clamps the flat cable.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which:

FIG. 2A is a plan view of the connector according to the invention;

FIG. 2B is a front view of the connector according to the invention;

FIG. 2C is a side view of the connector according to the invention;

DETAILED DESCRIPTION OF THE EMBODIMENT(S)

Figure 1:
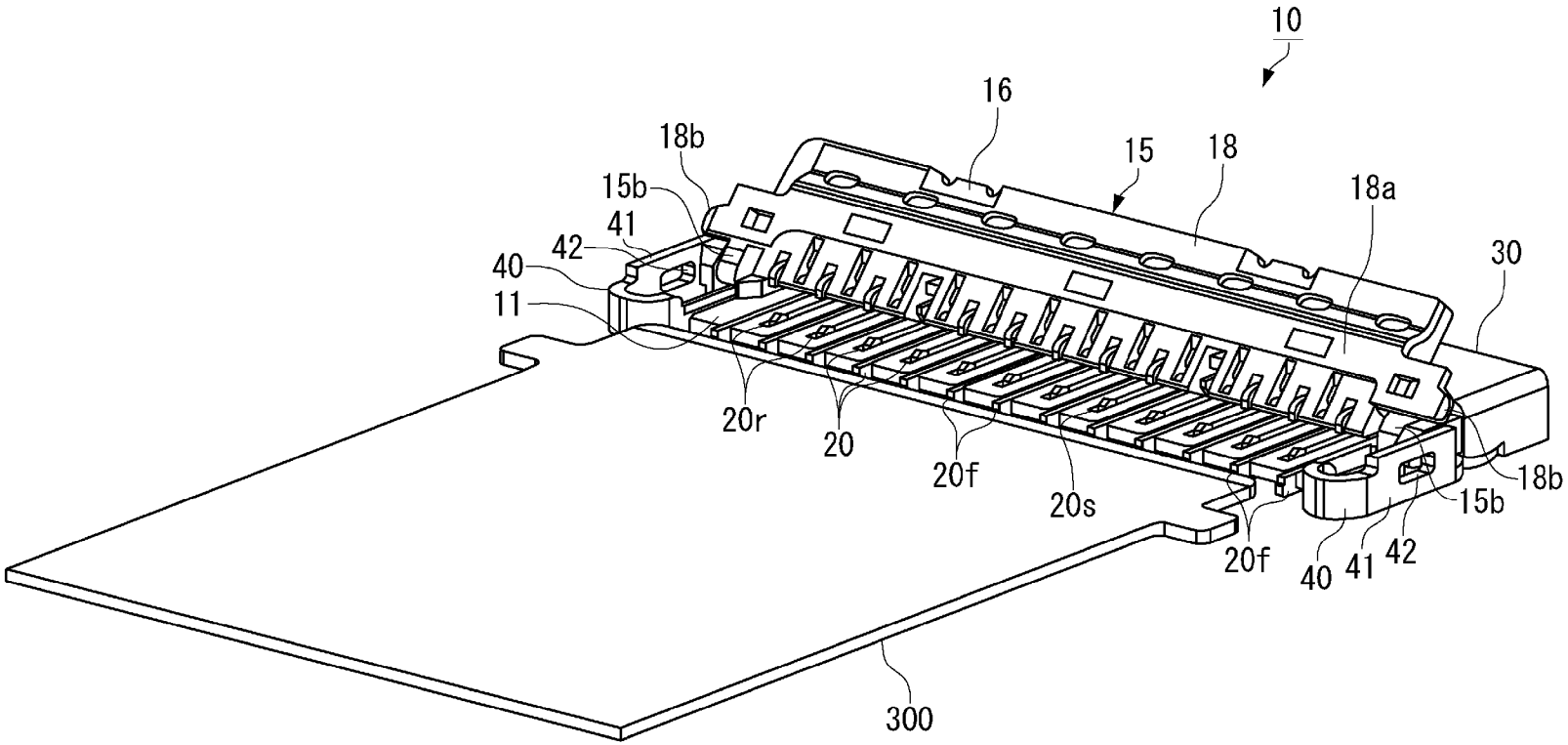
FIG. 1 is a perspective view of a connector according to the invention.
Figures 3A, 3B:
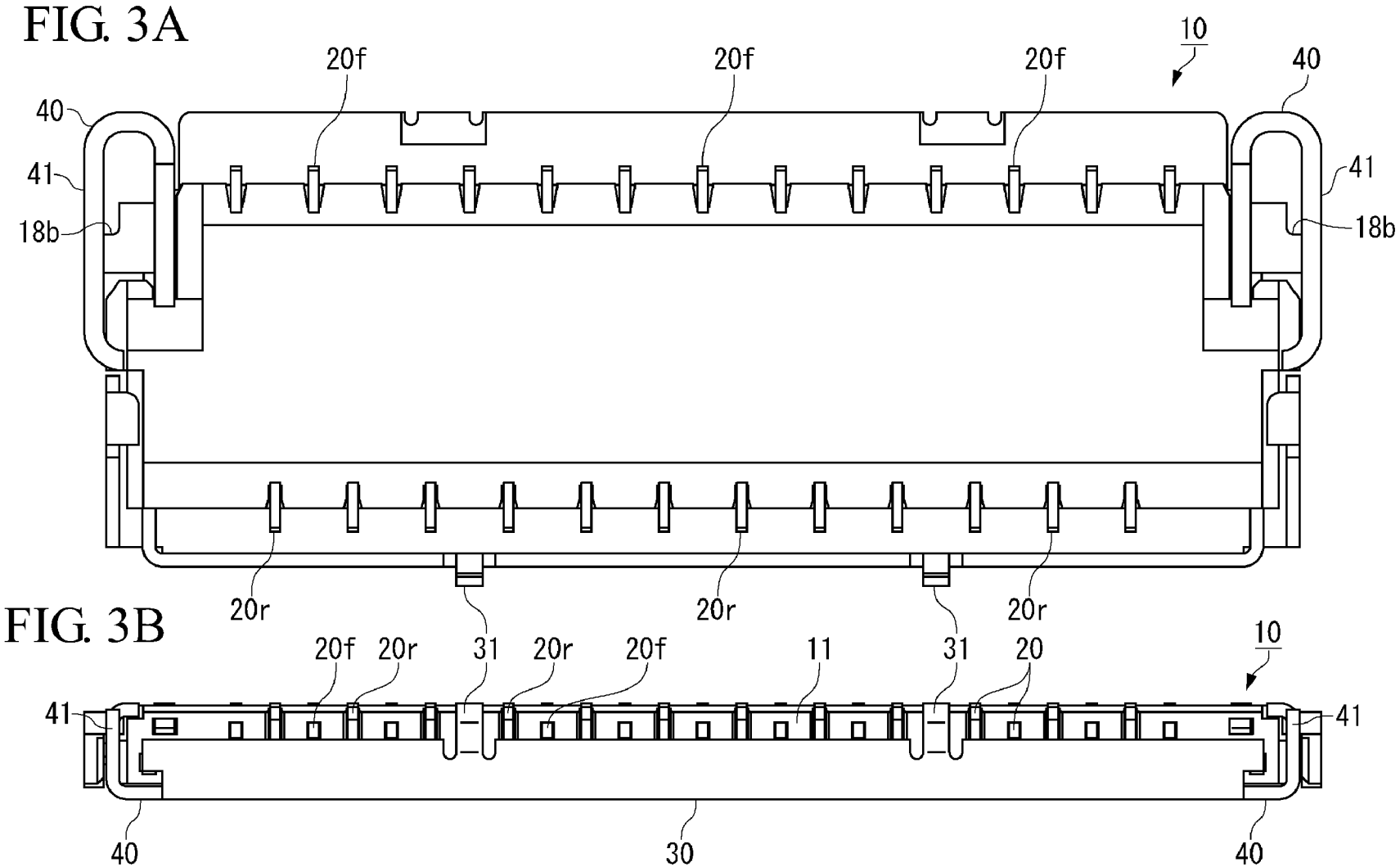
FIG. 3A is a bottom view of the connector according to the invention.
FIG. 3B is a rear view of the connector according to the invention.

Hereafter, an embodiment of the present invention will be described with reference to the drawings.

A connector 10 is mounted on a printed wiring board 100 (see FIG. 4) having a conductive pattern and a grounding pattern (not shown). The connector 10 electrically connects a flat cable 300 having flexibility to the printed wiring board 100 when an end of the flat cable 300 is inserted into the connector 10. A side of the connector 10 at which the flat cable 300 is inserted into the connector 10 will be referred to as a front side hereinafter. A side of the connector 10 at which the connector 10 is mounted on the printed wiring board 100 will be referred to as a lower side hereinafter.

The connector 10 includes a housing 11, a plurality of contacts 20 received in cavities 12 (see FIG. 4) of the housing 11, and an actuator 15 for operating the contacts 20. The contacts 20 have surfaces thereof plated with gold, tin or the like.

The housing 11 is made of an insulating material, such as a resin. In the housing 11, the plurality of contacts 20 that are to be electrically connected to conductors on the end of the flat cable 300 are arranged in a row in a width direction. Each contact 20 is press-fit into and held in a contact receiving groove formed in the housing 11.

The actuator 15 is made of an insulating material, such as a resin, and is disposed on the upper surface of the housing 11 at a position close to the front end thereof. The actuator 15 is pivotally mounted to the housing 11 at opposite ends 15*b* and 15*b* and can rotate about a rotational axis parallel to the width direction of the housing 11.

As shown in FIG. 4, the actuator 15 has a cam shaft 15*a* that extends along the rotational axis thereof. The cam shaft 15*a* has cams 17 formed at positions corresponding to front contacts 20*f* and rear contacts 20*r* of the contacts 20. The cam 17 is eccentric with respect to the center of rotation of the actuator 15.

When the actuator 15 is raised by a lever 16 thereof with respect to the housing 11 (as shown in FIGS. 5B to 6B), the front contacts 20*f* and the rear contacts 20*r* open to allow insertion of the flat cable 300 into the housing 11. Then, as shown in FIG. 6C, when the actuator 15 in the raised position is rotated counterclockwise, the cams 17 rotate, and the lower surface of the actuator 15 presses the contacts 20 with the flat cable 300 interposed therebetween. Accordingly, the contacts 20 are switched from being open state to being closed where the contacts 20 clamp the flat cable 300.

The actuator 15 incorporates a shield plate 18 made of a conductive material, such as metal. The shield plate 18 is integrally molded with the actuator 15 when the actuator 15 is manufactured. The shield plate 18 covers a surface of the actuator 15 from the front end to a part close to the rear end thereof when the actuator 15 is closed.

The shield plate 18 has a contact section 18*a* that is exposed on the lower surface of the actuator 15 when the actuator 15 is closed. The contact section 18*a* of the shield plate 18 presses the upper surface of the flat cable 300 when the actuator 15 is closed.

In addition, the shield plate 18 has contact pieces 18*b* at the opposite ends in the width direction thereof. When the flat cable 300 is clamped, the contact pieces 18*b* are inserted into engaging holes 42 in pegs 40 described later and come into contact with the inner wall of the engaging holes 42 to establish electrical connection between the shield plate 18 and the pegs 40.

The contacts 20 are formed by stamping a thin plate made of a conductive material, such as a copper alloy.

The contacts 20 include front contacts 20*f* that are inserted into the cavity 12 of the housing 11 from the front of the housing 11 and rear contacts 20*r* that are inserted into the cavity 12 of the housing 11 from the rear of the housing 11. The plurality of front contacts 20*f* and the plurality of rear contacts 20*r* are alternately arranged in the width direction of the housing 11. Both the front contacts 20*f* and the rear contacts 20*r* are contacts for signal transmission.

Besides the front contacts 20*f* and the rear contacts 20*r*, the connector 10 includes another contact: a shield contact 20*s*. The shield contact 20*s* is inserted from the front of the housing.

Figure 4A:
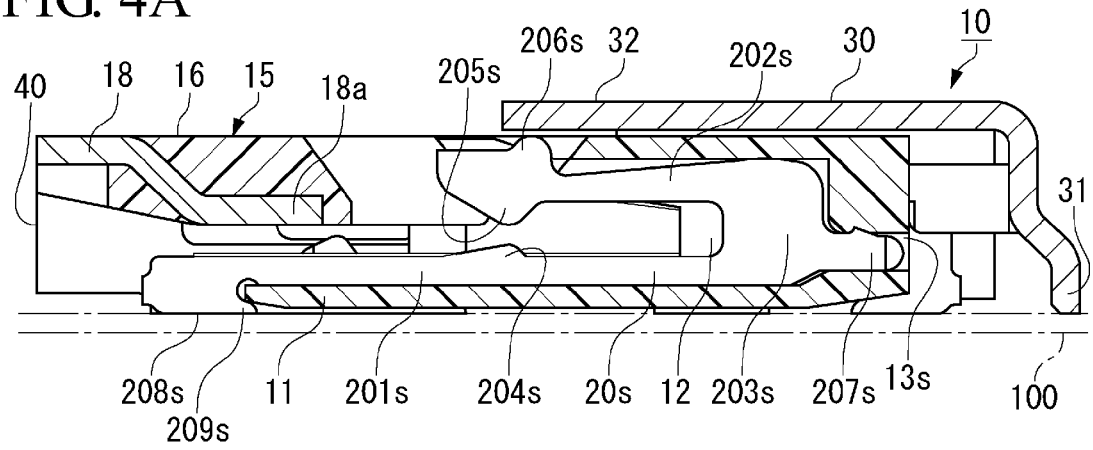
FIG. 4A is a cross-sectional view of the connector according to invention taken along the line shown by the arrows 4*a* in FIG. 2B.

As shown in FIG. 4A, the shield contact 20*s* is a contact of a tuning fork type that has a base 201*s* extending from the rear end toward the front end of the housing 11 where the shield contact 20*s* is set in the housing 11, an upper beam 202*s*, and a link 203*s* that couples the base 201*s* to the upper beam 202*s*.

The base 201*s* has a stopper claw 209*s* that is formed at the front end thereof to be engaged with the front end of the housing 11. The stopper claw 209*s* restricts rearward movement of the shield contact 20*s* when engaged with the front end of the housing 11. The bottom surface of the base 201*s* further forward from the stopper claw 209*s* forms a tine 208*s* that is to be electrically connected to the conductive pattern (or the grounding pattern, not shown) on the printed wiring board 100.

The base 201*s* has an upward-protruding contact section 204*s* that is formed in a middle part thereof in the front-rear direction to be electrically connected to a conductive pattern (not shown) on the lower surface of the flat cable 300.

The base 201*s* has a key 207*s* that is formed at the rear end thereof to be inserted into a recess 13*s* formed in the housing 11. The key 207*s* has a protrusion on the upper surface thereof, and the protrusion is press-fit into an inner wall of the recess 13*s* formed in the housing 11 to prevent the shield contact 20*s* from falling off the housing 11.

The upper beam 202*s* has a downward-protruding contact section 205*s* that is formed at the front end thereof to come into contact with the upper surface of the flat cable 300. The upper beam 202*s* further has an upward-protruding contact section 206*s* that is formed at the front end thereof to come into contact with the lower surface of a shield shell 30 when the flat cable 300 is inserted into the connector 10.

Figure 4B:
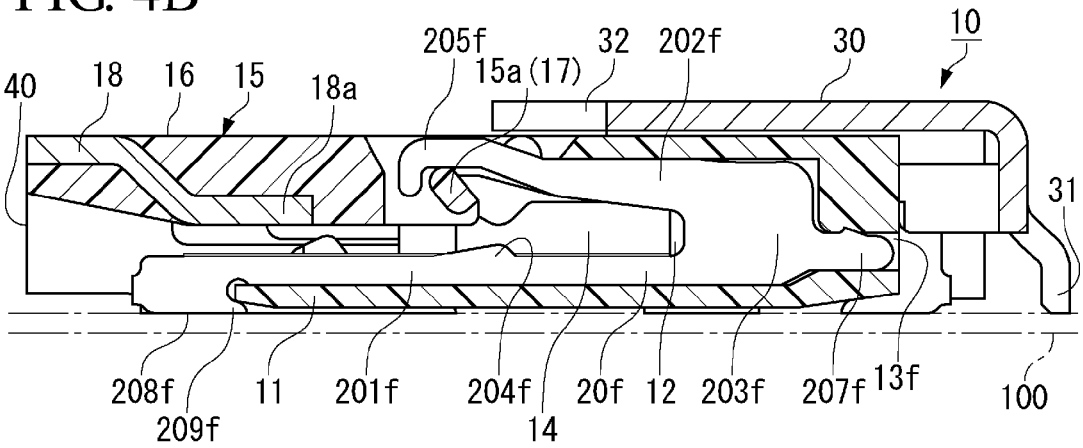
FIG. 4B is a cross-sectional view of the connector according to invention taken along the line shown by the arrows 4*b* in FIG. 2B.

As shown in FIG. 4B, the front contact 20*f* is a contact of a tuning fork type that has a base 201*f* extending from the front end toward the rear end of the housing 11 where the front contact 20*f* is set in the housing 11, an upper beam 202*f*, and a link 203*f* that couples the base 201*f* to the upper beam 202*f*.

The base 201*f* has a stopper claw 209*f* that is formed at the front end thereof to be engaged with the front end of the housing 11. The stopper claw 209*f*, when engaged with the front end of the housing 11, restricts rearward movement of the front contact 20*f*. The bottom surface of the base 201*f* further forward from the stopper claw 209*f* forms a tine 208*f* that is to be electrically connected to the conductive pattern (not shown) on the printed wiring board 100.

The base 201*f* has an upward-protruding contact section 204*f* that is formed in a middle part thereof in the front-rear direction to be electrically connected to the conductive pattern (not shown) on the lower surface of the flat cable 300.

The base 201*f* has a key 207*f* that is formed at the rear end thereof to be inserted into a recess 13*f* formed in the housing 11. The key 207*f* has a protrusion on the upper surface thereof, and the protrusion is press-fit into an inner wall of the recess 13*f* formed in the housing 11 to prevent the front contact 20*f* from falling off the housing 11.

A front end part 205*f* of the upper beam 202*f* is located above the cam 17 of the actuator 15 and is pressed by the cam 17 as the cam 17 rotates.

Figure 4C:
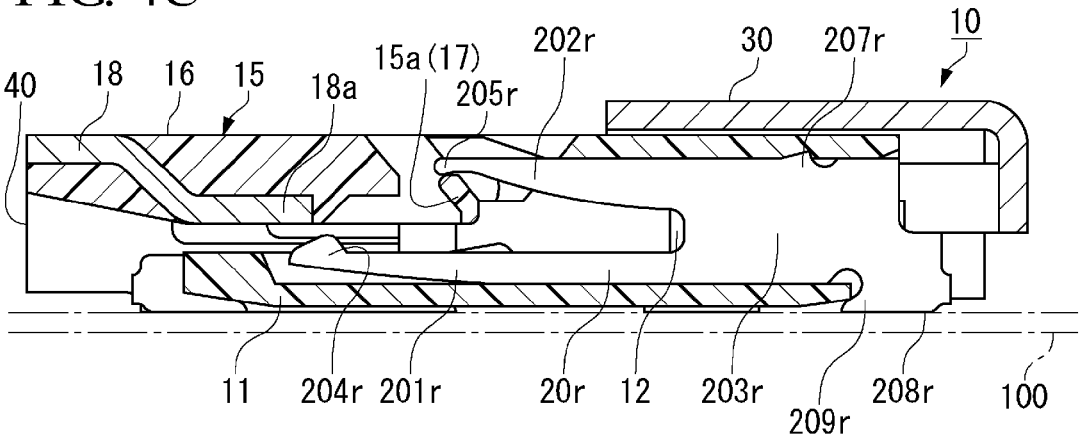
FIG. 4C is a cross-sectional view of the connector according to invention taken along the line shown by the arrows 4*c* in FIG. 2B.

As shown in FIG. 4C, the rear contact 20*r* is a contact of a tuning fork type that has a lower beam 201*r* extending in the front-rear direction of the housing 11 where the rear contact 20*r* is set in the housing 11, an upper beam 202*r*, and a link 203*r* that couples the lower beam 201*r* to the upper beam 202*r*.

The lower beam 201*r* has an upward-protruding contact section 204*r* that is formed at the front end thereof to be electrically connected to the conductive pattern (not shown) on the lower surface of the flat cable 300. The contact section 204*r* is pressed against the flat cable 300 by the elastic force of the cantilevered lower beam 201*r*.

A front end part 205*r* of the upper beam 202*r* is located above a cam 17 of the actuator 15 and is pressed by the cam 17 as the cam 17 rotates.

The link part 203*r* has a tine 208*r* that is formed on the bottom surface thereof to be electrically connected to the conductive pattern (not shown) on the printed wiring board 100. The link part 203*r* has a stopper claw 209*r* that is formed at the rear end thereof to be engaged with the rear end of the housing 11. The stopper claw 209*r* engaged with the rear end of the housing 11 restricts forward movement of the rear contact 20*r*. The link 203*r* has a protrusion 207*r* formed on the upper surface thereof, and the protrusion 207*r* is press-fit into an inner wall of the housing 11 to prevent the rear contact 20*r* from falling off the housing 11.

The housing 11 has the shield shell 30, which is made of a conductive material, such as metal, and covers the upper surface of the housing 11 close to the rear end thereof. The shield shell 30 is formed by stamping a plate made of a conductive material and covers a part of the upper surface, opposite side surfaces and rear surface of the rear end part of the housing 11. The shield shell 30 has, on the rear surface thereof, two grounding parts 31 that are to be electrically connected to the conductive pattern on the printed wiring board 100 by soldering (see FIG. 2A).

As shown in FIG. 2A, the shield shell 30 has extensions 32 that protrude forward. A total of two extensions 32 are provided at such positions that the extensions 32 divide the shield shell 30 into three approximately equal parts in the width direction. When the flat cable 300 is inserted into the connector 10, the extensions 32 come into contact with the contact sections 206*s* of the shield contacts 20*s* to establish electrical connection between the shield shell 30 and the shield contacts 20*s*.

From FIGS. 4A, 4B and 4C, it can be seen that there is an open space where the contacts 20 are exposed externally between the actuator 15 and the shield shell 30.

The pegs 40 are provided at the opposite ends of the housing 11 in the width direction to fix the connector 10 on the printed wiring board 100. The pegs 40 are made of a conductive material, such as metal. The pegs 40 are electrically connected to the grounding pattern (not shown) formed on the printed wiring board 100 by soldering. The pegs 40 are provided on both sides of the housing 11 and each has a beam 41 that extends rearward from the front end thereof.

The beam 41 has the engaging hole 42 that is formed to penetrate the beam 41 in the width direction of the housing 11. When the flat cable 300 is clamped, the tip end of the contact piece 18*b* of the shield plate 18 is inserted into and engaged with the engaging hole 42, and the contact piece 18*b* in contact with the inner wall of the engaging hole 42 establishes electrical connection between the shield plate 18 and the peg 40.

Next, with reference to FIGS. 4B and 4C, an operation of the front contact 20*f* and the rear contact 20*r* when the actuator 15 is operated will be described.

When the actuator 15 in the raised position is rotated counterclockwise in the drawing by the lever 16 of the actuator 15, the cams 17 come into contact with the lower surface of the front end parts 205*f*, 205*r* of the upper beams 202*f*, 202*r* to press the upper beams 202*f*, 202*r* upward. When the contact sections 204*f*, 204*r* are pressed by the flat cable 300 inserted into the cavity 12, the contact sections 204*f*, 204*r* are electrically connected to the conductive pattern formed on the lower surface of the flat cable 300. Then, the flat cable 300 is clamped between the contact section 18*a* of the shield plate 18 and, the contact sections 204*f* of the base 201*f* and the contact sections 204*r* of the lower beam 201*r*. In this way, pressure contact between the flat cable 300 and the contact sections 204*f*, 204*r* is assured. When the actuator 15 is pulled by the lever 16 to be substantially parallel to the surface of the printed wiring board 100, the actuator 15 is locked by the cams 17.

Next, with reference to FIGS. 5A, 5B, 6A, 6B and 6C, a process of inserting the flat cable 300 into the connector 10 and clamping the flat cable 300 in the connector 10 will be described.

Figure 5A:
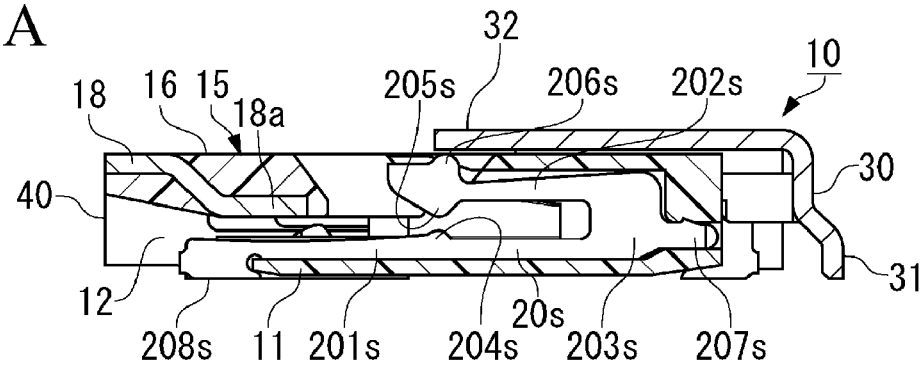
FIG. 5A is a cross-sectional view illustrating operation of an actuator before a flat cable is inserted into the connector according to the invention.
Figure 5B:
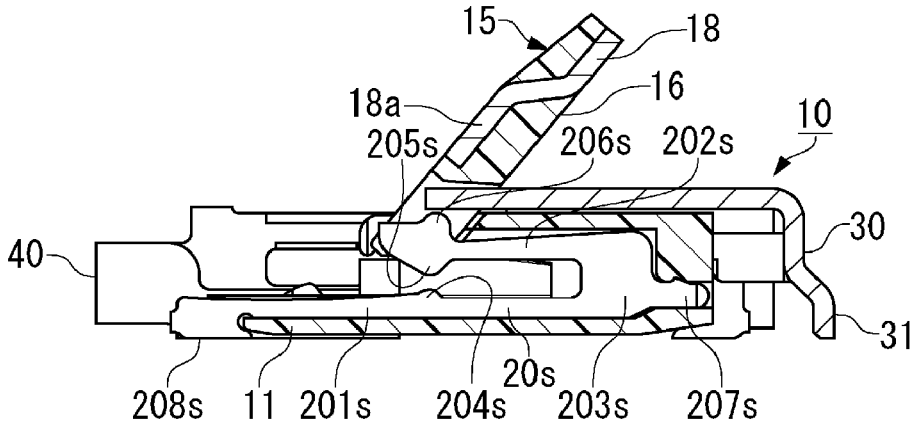
FIG. 5B is another cross-sectional view illustrating operation of the actuator before a flat cable is inserted into the connector according to the invention.

The actuator 15 that is initially in the closed position (shown in FIG. 5A) is raised (as shown in FIG. 5B) so that the flat cable 300 can be inserted into the connector 10. When the flat cable 300 has yet to be inserted, the contact sections 206*s* of the shield contacts 20*s* and the extensions 32 of the shield shell 30 are not in contact with each other, and a predetermined gap is provided between the contact sections 206*s* and the extensions 32.

Figure 6A:
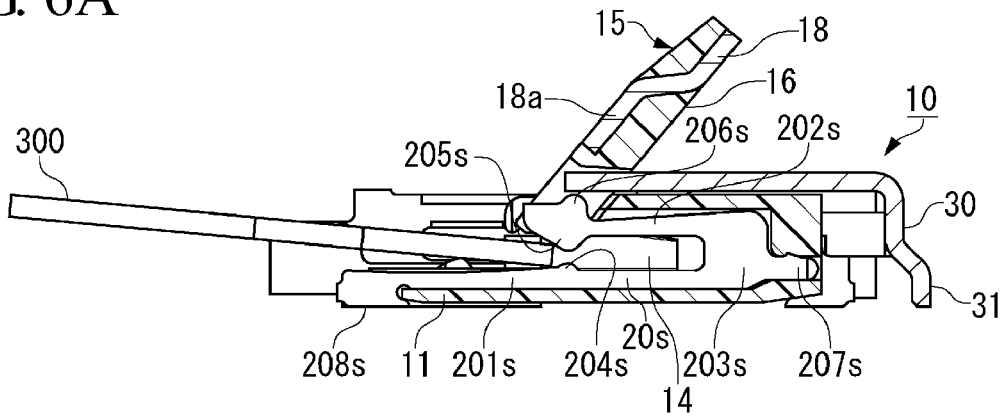
FIG. 6A is a cross-sectional view illustrating insertion of the flat cable into and clamping the flat cable in the connector according to the invention.
Figure 6B:
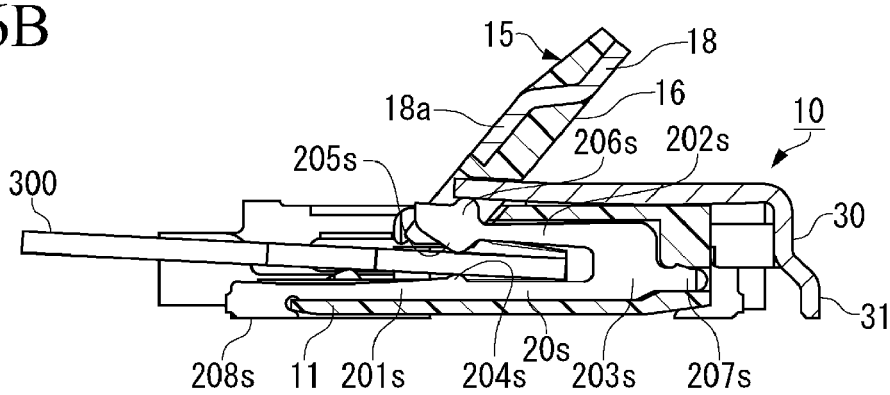
FIG. 6B is another cross-sectional view illustrating insertion of the flat cable into and clamping the flat cable in the connector according to the invention.

The flat cable 300 is inserted into a receiving section 14 of the housing 11 (FIG. 6A) and further pushed to the depth of the receiving section 14 through a gap between the contact sections 204*s* and the contact sections 205*s* of the shield contact 20*s* (FIG. 6B). Since the thickness of the flat cable 300 is greater than the gap between the contact sections 204*s* and the contact sections 205*s* in the open state, the flat cable 300 is in contact with the contact sections 205*s* of the shield contacts 20*s* and pushes the upper beams 202*s* of the shield contacts 20*s* upward. As a result, the contact sections 206*s* of the shield contacts 20*s* come into contact with the lower surface of the shield shell 30, and thus, electrical connection between the shield contact 20*s* and the shield shell 30 is established. In addition, when the flat cable 300 is pushed to the depth of the receiving section 14, the contact sections 204*s* of the shield contacts 20*s* come into contact with the conductive pattern on the lower surface of the flat cable 300, and thus, electrical connection between the shield contacts 20*s* and the conductive pattern is established.

Figure 6C:
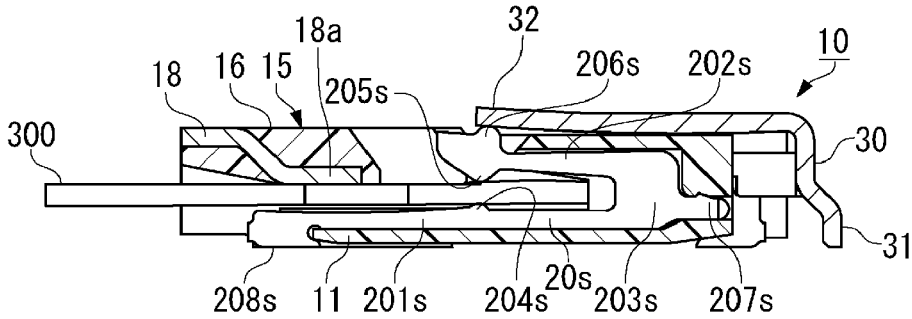
FIG. 6C is another cross-sectional view illustrating insertion of the flat cable into and clamping the flat cable in the connector according to the invention.

After the flat cable 300 is pushed to the depth of the receiving section 14, the actuator 15 is rotated downward by the lever 16 to be substantially parallel to the surface of the printed wiring board 100 (FIG. 6C). Then, the contact section 18*a* of the shield plate 18 presses the upper surface of the flat cable 300 downward, and thus the flat cable 300 is clamped.

When clamped, electrical connection between the shield contacts 20*s* and the shield shell 30 is maintained. The shield shell 30 has the grounding parts 31 connected to the printed wiring board 100 for grounding. The shield plate 18 of the actuator 15 is connected to the printed wiring board 100 via the pegs 40 for grounding. Therefore, the shield shell 30 and the shield plate 18 are both grounded.

Figure 7:
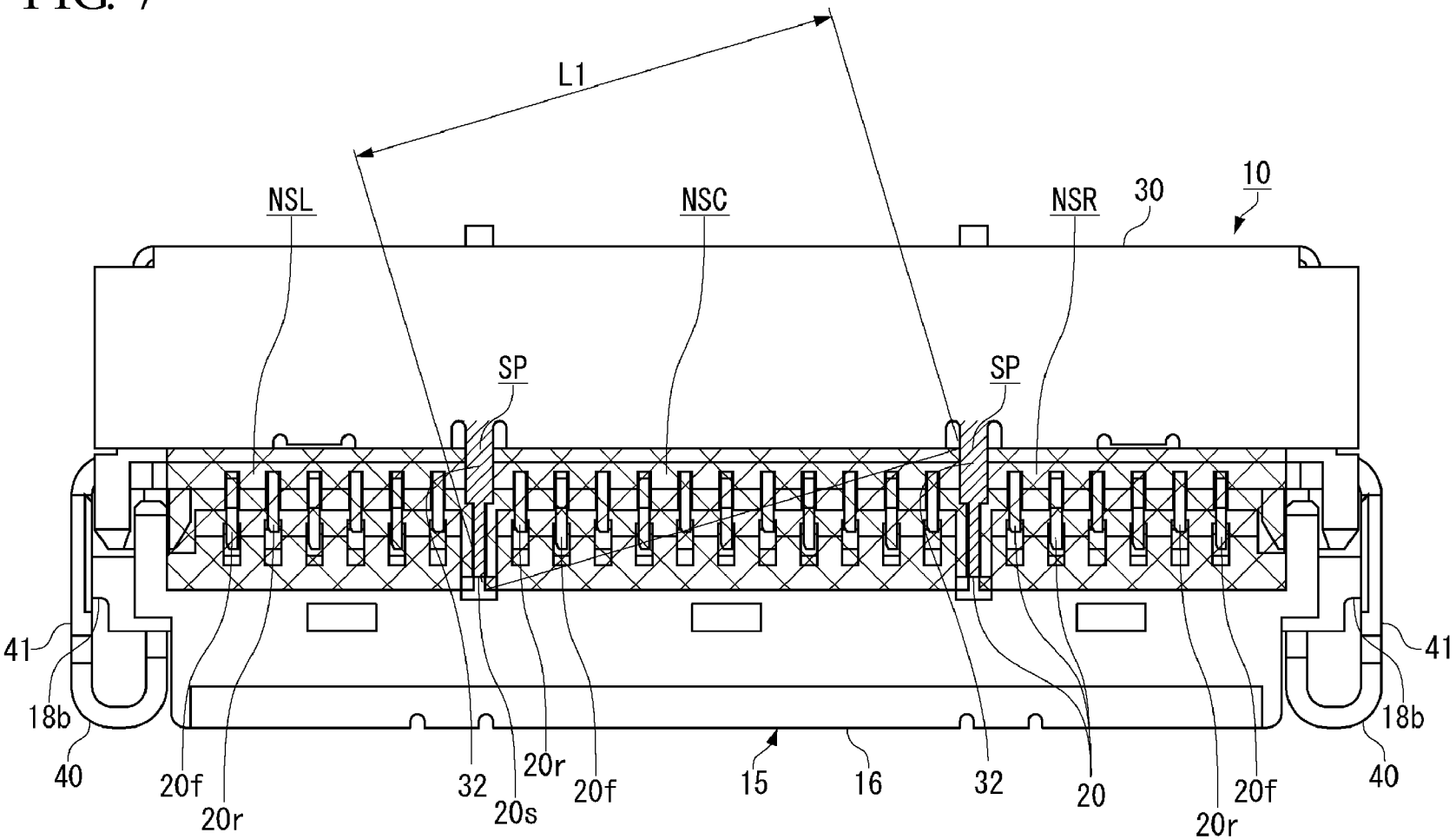
FIG. 7 is a plan view of the connector according to the invention showing dimensions of a non-shielded area.

FIG. 7 shows shield paths SP for the open space between the shield plate 18 and the shield shell 30 by hatching. The shield path SP is formed by the shield contact 20*s* and the extension 32. As shown in FIG. 7, the shield paths SP divide the cross-hatched non-shielded area into three parts. In this example, a central non-shielded area NSC is wider than left and right non-shielded areas NSL and NSR. Therefore, the largest dimension is the length L1 of the diagonal line of the non-shielded area NSC. Provided that the wavelength at the transmission frequency of the connector 10 is denoted by λ, the number and positions of shield contacts 20*s* are determined to meet a condition that $L1<\frac{1}{4}\lambda$.

Although the connector 10 has two shield paths SP over the open space, the invention is not limited to this arrangement, and the connector 10 may have a single shield path SP or three or more shield paths SP depending on the transmission frequency. The positions of the shield paths SP can also be arbitrarily determined.

For the connector 10 described above, the upper surface of the connector 10 is covered with the shield plate 18 of the actuator 15 and the shield shell 30, both of which are made of a conductive material, and the shield plate 18 and the shield shell 30 are grounded to the conductive pattern on the printed wiring board 100. In addition, the shield paths SP are formed over the open space between the shield plate 18 and the shield shell 30 to divide the non-shielded area into the left, right and central non-shielded areas NSL, NSR and NSC. As a result, the connector 10 can be shielded with reliability from electromagnetic waves produced by the connector 10 itself or external electromagnetic waves. In addition, the connector 10 does not require attachment of an additional component to provide shielding, and thus, the workability does not decrease.

Before the flat cable 300 is inserted, there is a predetermined gap between the contact sections 206*s* of the shield contacts 20*s* and the extensions 32 of the shield shell 30. Therefore, the shield shell 30 does not prevent the upper beams 202*s* of the shield contacts 20*s* from being elastically deformed and projecting upward to a predetermined extent. As a result, the upper beams 202*s* interfere less with the insertion of the flat cable 300, and the flat cable 300 can be more easily inserted into the connector 10.

In addition, upward movement of the cam shaft 15*a* of the actuator 15 is restricted by the upper beams 202*f* of the front contacts 20*f* and the upper beams 202*r* of the rear contacts 20*r*. Therefore, lifting of the middle part of the actuator 15 can be prevented, and the contact pressure of the middle part of the actuator 15 on the contacts 20 does not decrease.

Figure 8A:
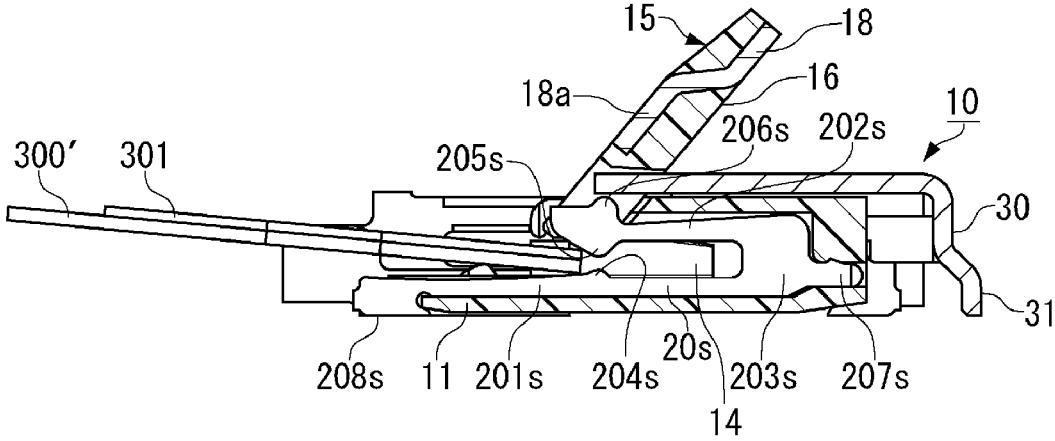
FIG. 8A is a cross-sectional view for illustrating insertion a flat cable having a shield layer into and clamping the flat cable in the connector according to the invention.
Figure 8B:
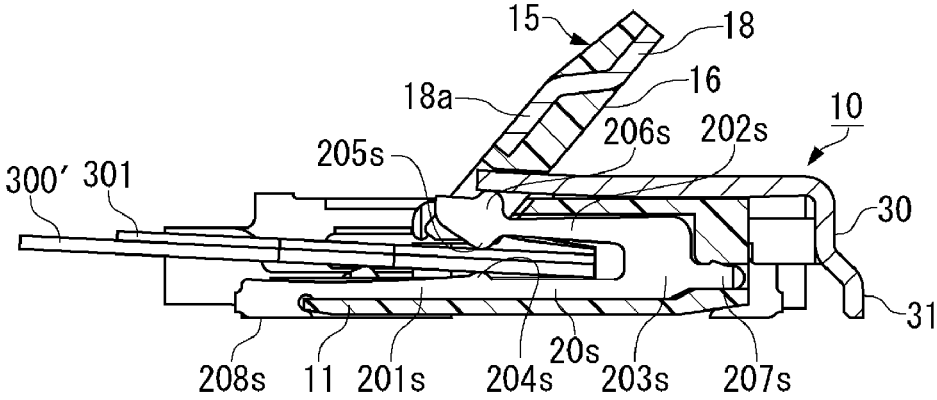
FIG. 8B is another cross-sectional view for illustrating insertion a flat cable having a shield layer into and clamping the flat cable in the connector according to the invention.
Figure 8C:
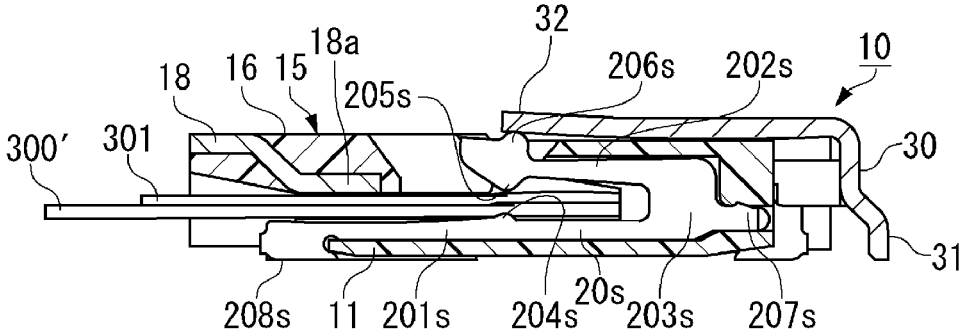
FIG. 8C is another cross-sectional view for illustrating insertion a flat cable having a shield layer into and clamping the flat cable in the connector according to the invention.

Incidentally, a flat cable having a shield layer made of a conductive material, such as carbon and silver paste, to provide shielding from electromagnetic waves can also be used. When the connector 10 receives the flat cable having the shield layer, the connector 10 can provide improved shielding. This will be described below with reference to FIGS. 8A, 8B and 8C. FIGS. 8A, 8B and 8C are the same as FIGS. 6A, 6B and 6C, except for a flat cable 300'.

A shield layer 301 is formed on the upper surface of the flat cable 300'.

In the state where the flat cable 300' is clamped, the contact section 18*a* of the shield plate 18 is located at such a position that the contact section 18*a* is electrically connected to the shield layer 301 of the flat cable 300' and presses the shield layer 301 of the flat cable 300', and thus, electrical connection between the shield plate 18 and the shield layer 301 is established. In addition, in the state where the flat cable 300' is clamped, the shield layer 301 of the flat cable 300' and the contact sections 205*s* of the shield contacts 20*s* are electrically connected to each other, and the contact sections 206*s* of the shield contacts 20*s* and the extensions 32 of the shield shell 30 are electrically connected to each other. Thus, the shield plate 18, the shield layer 301 of the flat cable, the shield contacts 20*s* and the shield shell 30 are electrically connected in this order, and are grounded and form shield paths. The shield paths are also formed in a projection plane of the shield layer 301 and therefore cover a wider part of the cross-hatched area than the shield paths SP shown in FIG. 7. Thus, if the flat cable 300' having the shield layer 301 is used with the connector 10, the shielding capability of the connector 10 can be improved.

In the embodiment described above, the actuator 15 is a so-called front-flip-type actuator that is opened on the front side at which the flat cable 300 is inserted. Of course, however, the actuator 15 can also be a back-flip-type that is opened at the rear side opposite to the side at which the flat cable 300 is inserted. In addition, the position of the actuator 15 is not limited to the position close to the front end of the housing 11 and can be a position close to the rear end thereof or other positions.

Detail configurations of the components, such as the housing 11 and the contacts 20, can be appropriately modified without departing from the spirit of the present invention.

What is claimed:

1. An electrical connector that is mounted on a surface of a printed wiring board and electrically connects a flexible flat cable to the printed wiring board, the electrical connector comprising:

a housing made from an insulating material and into which an end of the flat cable having a shield layer is inserted from one end side to the other end side;

an actuator positioned at the one end side or the other end side of the housing and having cams;

a shield plate positioned with the actuator and made from a conductive material, the shield plate covering an upper surface of the electrical connector at the one end side or the other end side;

a plurality of signal contacts being arranged along a width of the housing, and being electrically connected to the printed wiring board, the plurality of signal contacts cooperating with the actuator through the cams to clamp the end of the flat cable while being electrically connected to the printed wiring board;

a shield contact disposed between the plurality of signal contacts in the housing;

a pair of pegs positioned on opposite ends of the housing and electrically connected to a grounding pattern on the printed wiring board, the pair of pegs are in contact with the shield plate when the actuator clamps the end of flat cable; and a shield shell made from a conductive material and covering an upper surface of the housing, the shield shell connected to the grounding pattern on the printed wiring board;

wherein the shield plate, the shield layer of the flat cable, the shield contact and the shield shell are electrically connected and form a shield path when the actuator clamps the flat cable.

2. The electrical connector according to claim 1, further comprising a gap positioned between the shield contact and the shield shell.

3. The electrical connector according to claim 1, wherein the flat cable is inserted into a gap and the shield contact is pressed by the flat cable to come into contact with the shield shell and be electrically connected to the shield shell.

4. The electrical connector according to claim 1, wherein the shield contact is grounded to the grounding pattern on the printed wiring board.

5. The electrical connector according to claim 3, wherein the shield contact is grounded to the grounding pattern on the printed wiring board.

6. The electrical connector according to claim 1, wherein each of the pair of pegs includes an engaging hole.

7. The electrical connector according to claim 6, further comprising a pair of contact pieces positioned on opposite ends of the shield plate.

8. The electrical connector according to claim 7, wherein each pair of engaging holes engages with and corresponds to the pair of contact pieces.

9. The electrical connector according to claim 1, wherein the shield path associated with the shield contact divides an open space between the shield plate of the actuator and the shield shell above the signal contacts in the width direction.

10. The electrical connector according to claim 1, wherein the actuator is pivotally mounted to the housing at opposite ends and can rotate about a rotational axis parallel to a width of the housing.

11. The electrical connector according to claim 1, wherein the shield plate includes a contact section that is exposed on the lower surface of the actuator when the actuator is closed.

12. The electrical connector according to claim 11, wherein the contact section presses the upper surface of the flat cable when the actuator is closed.

13. The electrical connector according to claim 1, wherein the shield contact is a tuning fork type contact having a base extending from a rear end toward a front end of the housing where the shield contact is positioned in the housing, an upper beam, and a link that couples the base to the upper beam.

14. The electrical connector according to claim 13, wherein the base includes a stopper claw formed at the front end thereof which engages the front end of the housing.

15. The electrical connector according to claim 14, wherein the stopper claw restricts rearward movement of the shield contact when engaged with the front end of the housing.

16. The electrical connector according to claim 14, wherein the bottom surface of the base further forward from the stopper claw forms a tine that is electrically connected to the conductive pattern on the printed wiring board.

17. The electrical connector according to claim 14, wherein the base includes an upwardly protruding contact section electrically connected to a conductive pattern on the lower surface of the flat cable.

18. The electrical connector according to claim 17, wherein the base further includes a key to be inserted into a recess formed in the housing to prevent the shield contact from falling off the housing.

19. The electrical connector according to claim 1, wherein the plurality of signal contacts include front contacts that are inserted into a cavity of the housing from the front of the housing and rear contacts inserted into the cavity from the rear of the housing.

20. The electrical connector according to claim 19, wherein the front contacts and the rear contacts are alternately arranged along the width the housing 11.

21. The electrical connector according to claim 20, wherein the front contacts contact includes a base extending from the front end toward the rear end of the housing, an upper beam, and a link that couples the base to the upper beam.

22. The electrical connector according to claim 21, wherein the rear contact includes a lower beam extending in the front-rear direction of the housing, an upper beam, and a link that couples the lower beam to the upper beam.

* * * * *